US006962103B2

(12) United States Patent
Sandlin

(10) Patent No.: US 6,962,103 B2
(45) Date of Patent: Nov. 8, 2005

(54) MULTI-STROKE CYLINDER

(75) Inventor: William C. Sandlin, Dallas, TX (US)

(73) Assignee: Ultramation, Inc., Waco, TX (US)

( * ) Notice: Subject to any disclaimer, the term of this patent is extended or adjusted under 35 U.S.C. 154(b) by 0 days.

(21) Appl. No.: 10/718,556

(22) Filed: Nov. 24, 2003

(65) Prior Publication Data

US 2004/0099135 A1 May 27, 2004

Related U.S. Application Data

(63) Continuation of application No. 09/750,092, filed on Dec. 29, 2000, now Pat. No. 6,651,546.

(51) Int. Cl.[7] ..... F01B 7/20
(52) U.S. Cl. ..... 92/13.1; 92/164
(58) Field of Search ..... 92/13.1, 13.3, 92/13.4, 52, 62, 107, 110, 112, 255, 164; 91/167 R, 169, 181

(56) References Cited

U.S. PATENT DOCUMENTS

| | | | | |
|---|---|---|---|---|
| 350,862 | A | | 10/1886 | Bowers |
| 1,054,197 | A | | 2/1913 | Goyder et al. |
| 2,005,387 | A | | 6/1935 | Pelton |
| 2,172,002 | A | | 9/1939 | Stanley |
| 2,484,603 | A | | 10/1949 | Audemar et al. |
| 2,630,786 | A | * | 3/1953 | Poore ..... 92/62 |
| 2,634,773 | A | | 4/1953 | Weyant |
| 2,893,209 | A | | 7/1959 | Colley |
| 2,915,043 | A | * | 12/1959 | Neiner ..... 92/62 |
| 3,500,744 | A | | 3/1970 | Lewis |
| 3,523,444 | A | | 8/1970 | Lucky |
| 3,523,445 | A | | 8/1970 | Pennington |
| 3,548,714 | A | | 12/1970 | Barrett |
| 3,633,465 | A | | 1/1972 | Puster |
| 3,911,790 | A | | 10/1975 | Gaitten |
| 3,935,795 | A | | 2/1976 | Hawley |
| 4,079,617 | A | | 3/1978 | Whiting |
| 4,205,594 | A | | 6/1980 | Burke |
| 4,806,195 | A | | 2/1989 | Mamysl |
| 5,431,087 | A | | 7/1995 | Kambara |
| 5,568,761 | A | | 10/1996 | Legendre |

FOREIGN PATENT DOCUMENTS

| | | |
|---|---|---|
| FR | 498633 | 4/1919 |
| SU | 881382 | 11/1981 |

* cited by examiner

*Primary Examiner*—F. Daniel Lopez
(74) *Attorney, Agent, or Firm*—Benner & Witcoff, Ltd.

(57) ABSTRACT

A multi-stroke air cylinder providing a precisely directed and controlled stroke in the face of lateral, torsional and tilting loads on a tooling plate. The multi-stroke cylinder utilizes a plurality of mechanically linked pneumatic or hydraulic pistons having different stroke lengths that can be added together in any combination, allowing the user to select any stroke length up to a predetermined, total combined stroke length, in increments equal to the stroke length of the smallest cylinder. The multi-stroke cylinder includes a head assembly having a fluid inlet for introducing fluid to the cylinder at a first pressure. The cylinder also includes a first positioning system having a plurality of pistons capable of moving a piston rod away from the first positioning system, and a second positioning system located between the head assembly and the first positioning system. The second positioning system comprises a plurality of movable pistons for displacing the piston rod a preselected distance and at least one elongated fluid supply member secured to a respective one of the pistons of the second positioning system for introducing a fluid between adjacent pistons. When a plurality of fluid supply members are used in the second positioning system, they are concentrically arranged and are at least partially coextensive with one another.

25 Claims, 16 Drawing Sheets

MULTI-STROKE CYLINDER

RELATED APPLICATION

This application is a continuation of U.S. patent application Ser. No. 09/750,092, filed Dec. 29, 2000, now U.S. Pat. No. 6,651,546, the full disclosure of which is incorporated herein by reference.

FIELD OF THE INVENTION

The present invention relates to a multi-stroke linear actuator capable of achieving a predetermined number of discrete positions, more particularly, it relates to a linear actuator for accurately moving a tooling member a preselected distance.

BACKGROUND OF THE INVENTION

Many conventional devices are known for guiding and positioning a tool or an element, such as a parts gripper, with respect to a work piece. These devices range from simple hand-operated mechanical devices to more accurate and automatic, fluid operated devices in which the tool can be located in numerous positions by controlling the pressure and amount of the fluid. Such devices are commonly used in a variety of environments to perform a multitude of work functions such as the pick-up placement of parts in assembly lines, and the positioning of work pieces or tools for operations such as punching, drilling, printing, clamping and so forth. The devices can also be used to position individual parts for automatic assembly, etc. In each of these jobs, repetitive, precise and accurate movement in the face of undesired external loads is essential.

Pneumatic and hydraulic operated fluid devices accomplish movement of a tool or work piece by a power mechanism acting on a tooling plate. One conventional power mechanism includes a double action piston located within a cylinder and integrally connected to a piston rod. Pneumatic or hydraulic pressure is applied to either side of the piston so that a pressure differential is created across the piston. The differential pressure in the cylinder controls the location of the piston. It causes the piston to displace within the cylinder until the force on both sides of the piston is equal. The displacement, or stroke, of the piston rod is generally limited to the distance the piston can displace within the cylinder. This type of a system can be disadvantageous if the fluid medium is compressed air and the piston is floating in the cylinder and finally positioned by equal fluid forces being established on opposite sides of the piston. In heavy machine tool work, the forces created between the tools and the work can add to the force on one side of the piston within the cylinder, upsetting the equilibrium and throwing the tool out of alignment.

One manner of overcoming this disadvantage has been to utilize a plurality of fluid-actuated cylinders, such as hydraulic cylinders that do not rely on the establishing of equilibrium pressure. These cylinders have piston strokes of varying lengths and are stacked in an end-to-end relationship to provide a more rigid connection between the controlled tool and the positioning device. Such a device is disclosed in U.S. Pat. No. 3,633,465 to Puster. The actuated pistons disclosed in Puster slide the cylinders a distance that is equal to the sum of the stroke lengths of each actuated cylinder. Sizing the cylinders so that each has a different stroke length allows the device to achieve a large number of positions. Conventional multi-stroke, actuated cylinders are not laterally stable and occupy an excessive amount of space during use. In addition, many of these conventional actuators utilize position feedback mechanisms for insuring the accuracy of the positioning of the tooling plate. Typically, these feedback mechanisms include sensitive electrical feedback loops that can cause radio frequency interference with the power and fluid control mechanisms. Also, the use of electrical feedback or position control mechanisms can require shaft encoders that impose a risk of sparks or shorts, thereby creating explosive or otherwise hazardous conditions.

It is an object of the present invention to overcome the disadvantages of the prior art. It is also an object of the present invention to provide a multi-stroke cylinder capable of accurately achieving a large variety of positions without the use of a position feedback mechanism.

SUMMARY OF THE INVENTION

The present invention relates to a multi-stroke air cylinder that provides a precisely directed and controlled stroke in the face of lateral, torsional and tilting loads on a tooling plate. The present invention can use binary techniques or combinations of stroke increments to provide a precise positioner utilizing pneumatic or hydraulic power that provides accurate positioning of a tool without requiring or using position feedback mechanisms. Also, the air cylinder is laterally stable so it can be used in areas such as woodworking, apparel manufacturing, building materials, housing construction and other similar arts.

The present invention utilizes a plurality of mechanically linked pneumatic or hydraulic pistons having different stroke lengths that can be added together in any combination, allowing the user to select any stroke length up to a predetermined, total combined stroke length, in increments equal to the stroke length of the shortest stroke piston. For example, if the invention included four pistons having stroke lengths of one inch, two inches, four inches and eight inches, the user can select any stroke length in increments of one inch up to a total combined stroke length of fifteen inches. A three inch stroke would be obtained by extending the one inch stroke piston and the two inch stroke piston. A seven inch stroke would be obtained by extending the one inch stroke piston, the two inch stroke piston and the four inch stroke piston. The activation and extension of all of the pistons would achieve a fifteen inch stroke. The present invention also includes a plurality of pistons that can move the tooling plate by a fraction of an inch. This fractional movement can be added to the movement of the pistons having full inch increments so that positions in increments of the smallest fraction of an inch can be achieved up to the aggregate stroke length of all of the pistons.

The multi-stroke cylinder according to the present invention includes a head assembly having a fluid inlet for introducing fluid to the cylinder at a first pressure. The cylinder also includes a first positioning system having a plurality of pistons capable of moving the piston rod away from the first positioning system. A second positioning system is located between the head assembly and the first positioning system. The second positioning system comprises a plurality of movable pistons for moving the piston rod a preselected distance and a plurality of fluid supply members which are each secured to a respective one of the pistons of the second positioning system for introducing a fluid between adjacent pistons. The fluid supply members are concentrically arranged and are at least partially coextensive with one another. The disadvantage previously discussed concerning differential pressure pistons does not occur with the present invention because an equilibrium is not established. Instead, low pressure used to maintain the rest position of the pistons is expelled from the cylinder of the second positioning system as the piston is moved by the higher pressure introduced through the fluid supply members.

The first or "fine" positioning system utilizes a plurality of positioning stages having increments of movement in 1/16 of an inch intervals up to a total of 15/16 of an inch. The smallest of the different sized stages is 1/16 of an inch. The second or "coarse" positioning system has increments of movement set in one inch intervals up to a total of fifteen inches. In this system, the pistons would be set to extend at different lengths with the smallest stage length being one inch. By activating the coarse and fine positioning systems, the tooling plate of the present invention can be positively positioned in as many as 256 individual positions. If an additional stage capable of 1/32 of an inch were added, the number of discrete positions that could be achieved would be doubled to 512, thereby increasing the accuracy of the multi-stroke cylinder. Similarly, adding another stage capable of 1/64 of an inch movement could again double the accuracy while quadrupling the original number of discrete positions obtainable to 1024.

The present invention accurately positions the head of a piston rod or other similar devices such as a tooling plate in one, two or three planes by activating one or a plurality of pistons within a cylinder. Valves control the flow of the fluid medium within the cylinder and between the pistons. The head of the tooling piston or plate can securely and accurately carry any number or types of tools for performing an application on a work piece. For instance, by attaching a drill, the user could accurately drill a hole anywhere in an X-Y plane to a depth of Z and repeat the same controlled drilling depth at a second location. Alternatively, the hole could be drilled to a different depth at the second location. By attaching a parts gripper, the operator could retrieve a part from a known inventory position and place it accurately in an assembly a predetermined distance away. The present invention allows these applications to occur without the forces generated at the work piece affecting the position of the head of the piston rod.

Unlike conventional multi-stroke actuators and their related methods for carrying out the above discussed tasks, the embodiments according to the present invention do not require a feedback mechanism to insure the positioning accuracy of the tooling piston or plate. Selecting the proper combination of valves insures that the piston rod moves positively to the selected position. An additional advantage arises from the exclusive use of fluid power to carry out the positioning, thereby eliminating the necessity of employing electrical counters or shaft encoders which impose the risk of sparks or shorts in explosive or otherwise hazardous conditions. Furthermore, the present invention is completely free of radio-frequency interference since no sensitive electrical feedback loops are required. The multi-stroke cylinders according to the present invention are also compact in size and laterally stable so that they are able to be used in a variety of locations for performing many different operations.

DETAILED DESCRIPTION OF THE INVENTION

Figure 1:
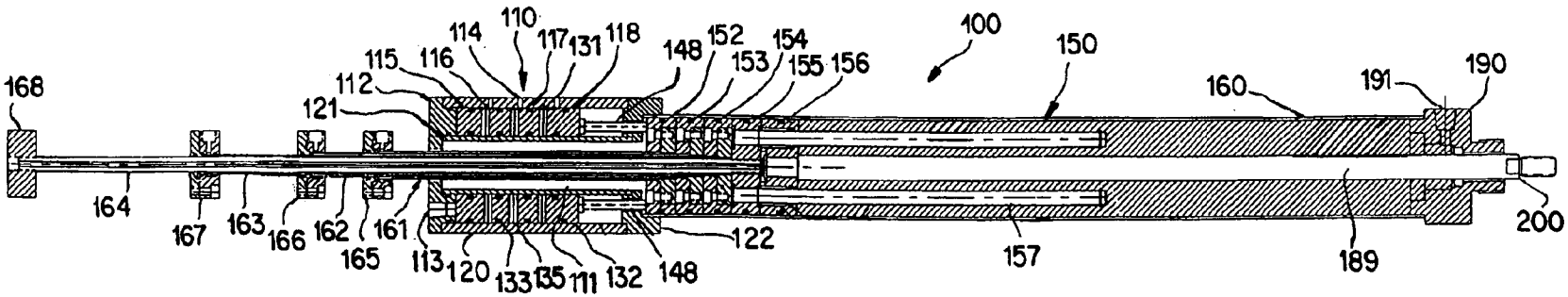
FIG. 1 is a schematic view of a multi-stroke cylinder according to an embodiment of the present invention.
Figure 2:
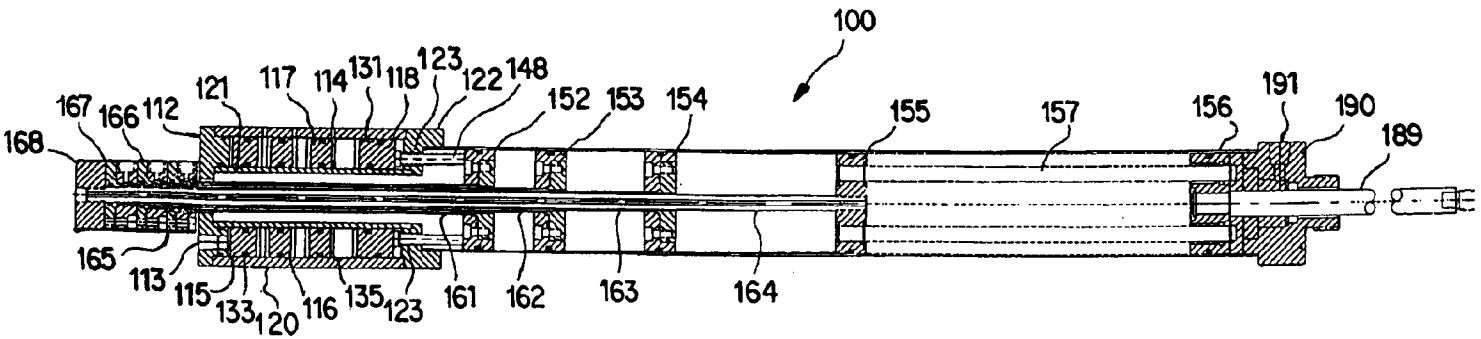
FIG. 2 is a schematic view of the multi-stroke cylinder shown in FIG. 1 with the stages in an extended state.

A multi-stroke air or hydraulic cylinder according to the present invention is shown in FIG. 1. This invention utilizes floating, tethered power pistons interconnected in such a manner as to cause an output piston rod 189 to move a distance equal to the sum of all the distances moved by each of the individual pistons. FIG. 1 schematically illustrates the multi-stroke cylinder 100 in a fully retracted condition. FIG. 2 illustrates the multi-stroke cylinder 100 with its stages, pistons, in a fully extended condition. The first positioning system 110 includes four pistons having fractional stroke lengths (fractions of an inch) located within an annular cylindrical housing 120. A second positioning system 150 includes four pistons having longer strokes (multiples of one inch) located within a conventional cylinder 160.

High pressure fluid is introduced between the pistons through a fluid inlet 114. This introduced fluid causes the pistons to separate to the extent permitted by respective tethering mechanisms in order to move piston rod 189 a predetermined distance. A low pressure fluid, at approximately ¼ to ½ the pressure of the high pressure fluid, is introduced at the end of the second positioning system 150 closest to piston rod 189 to return the pistons of both positioning systems and piston rod 189 to their rest positions. In a preferred embodiment, air or line air is provided at a high pressure of substantially between 80 PSI and 250 PSI with the low pressure being substantially between 20 PSI and 125 PSI. The cross-hatching shown in FIG. 1 between piston 156 and head assembly 190 illustrates the presence of low pressure air. The lack of cross-hatching and the extended condition of the device as shown in FIG. 2 illustrates when high pressure air has been introduced between the pistons.

As shown in FIG. 1, the first positioning system 110 includes the annular cylindrical housing 120 having an opening 111 through its center section 121 for the passage of tubes 161–164 which supply compressed air to the second positioning system 150. A first stroke piston 115 is positioned against a back plate 112 of housing 120 when it is at rest. The piston 115 is moved a predetermined distance when the introduction of compressed air via a port 113 extending through the rear plate 112 overcomes the low pressure holding the pistons at rest. The remaining pistons 116–118 are supplied with high pressure fluid through input ports 114 which enter the annular cylinder wall 125 at right angles to the direction in which pistons 115–118 move. Input ports 114 can be positioned at other angles relative to the direction that pistons 115–118 move.

Figure 5:
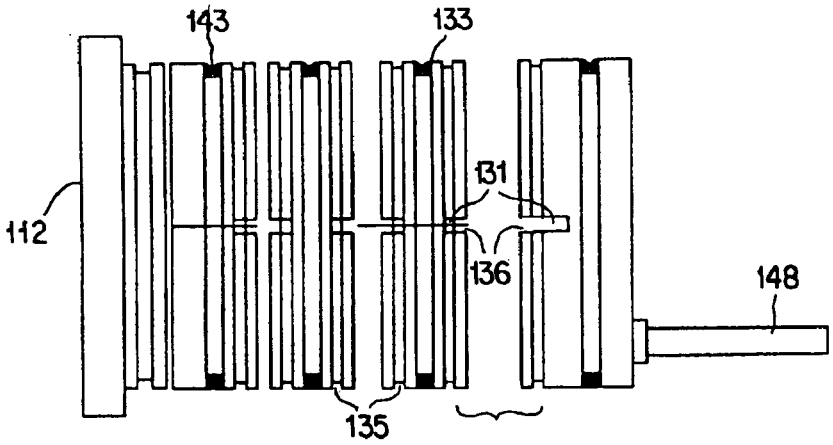
FIG. 5 illustrates the back plate and pistons of the first positioning system according to the embodiment shown in FIG. 1 in an extended state.
Figure 6:
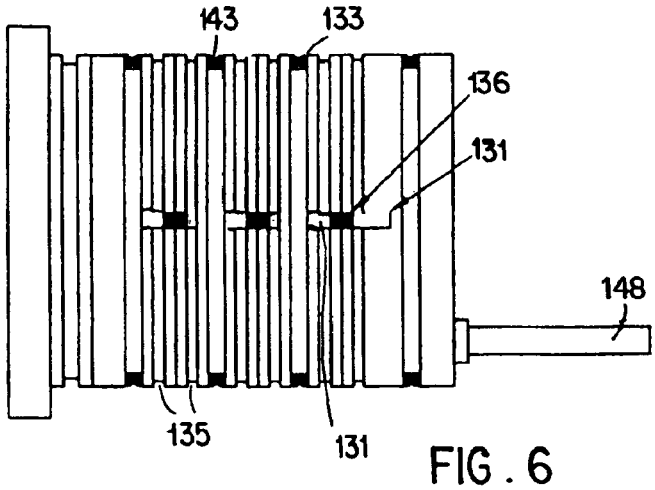
FIG. 6 is a schematic view of the first positioning system shown in FIG. 5 at rest.

In order to facilitate the entry of the compressed air into and out of the spaces between each of the moveable pistons 115–118, a shallow slot 131 is formed in each piston wall 132 on one or both sides of the piston seal slot 133. Slots 131 extend parallel to the direction of travel of the pistons and are aligned with input port orifices 114, as shown in FIGS. 1, 5 and 6. In FIG. 5, shallow grooves 135, cut into the perimeter of each piston, connect each of the slots 131 to three grooves 136 cut radially into the piston faces. Grooves 136 are cut into the pistons 120° apart from each other. Once compressed air is delivered between all or some of the pistons 115–118, the selected pistons are spaced apart a predetermined distance for causing a predetermined amount of movement of positioning rod 189. The result is a calibrated movement of the piston rod 189 outward as high pressure air fills the precise voids between the pistons and overcomes the force of the low pressure air tending to push them toward the back of the housing 120. Any number of grooves 136 such as two to six, can be formed on the piston faces so that fluid will flow between adjacent pistons.

Figure 4:
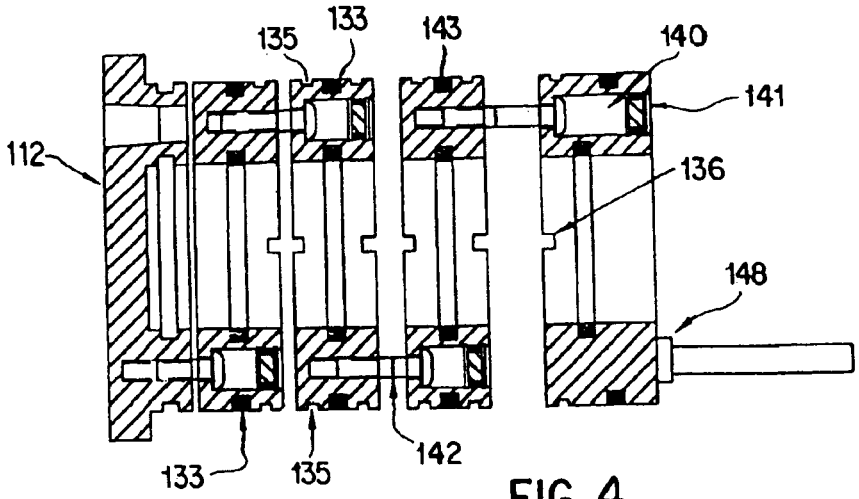
FIG. 4 illustrates a cross section of the back plate and pistons of the first positioning system according to the embodiment shown in FIG. 1.

For the sake of clarity, FIG. 4 shows a cross section of the first positioning system at full extension but without the confining cylindrical housing 120 or center tube 121. Sets of locked tethering screws 142 extend between adjacent pistons for limiting their relative and total movement. While tethering screws are discussed with this embodiment, other known tethering members such as those discussed below could also be used. Each set of tethering screws 142 includes at least three screws that limit the travel of their respective piston to a predetermined distance relative to the rear plate 112 or to the piston at its left (as shown in the figures). The tethering screws 142 are secured within the adjacent pistons so that they are slidable relative thereto. Three rigid inter-stage pusher rods 148 extend from positioning system 110 and transmit the cumulative movement of all four pistons 115–118 to a fractional stroke piston 152 in the second positioning system 150. O-rings 141 seal the tethering screw cavities 140 containing tethering screws 142. A seal 143 such as an O-ring is positioned in each slot 133 for preventing fluid from passing between each piston and the inner surface of the cylinder 120. Seal 143 is also used between the inner surface of the pistons 115–118 and the outer surface of center tube 121. FIG. 5 shows an outside view of FIG. 4 and illustrates the slots 131 machined axially along the outer, circumferential edge of the annular pistons which connect with the grooves 136 formed across the faces of the pistons in a direction perpendicular to the path of travel of the pistons for the purpose of allowing quick flow of high pressure air from its introduction at ports 114 along the perimeter of the pistons to the working faces thereof. The grooves 136 and slots 131 can be formed by any well known process such as machining, abrading, etc. Additionally tubes or other fluid conduits could be used to present the line air introduced through port 114 to the facial grooves 136. FIG. 6 shows the annular pistons in the fully retracted condition and illustrates the axial slots 131 and the facial grooves 136.

An intermediate plate 122, shown in FIG. 2, connects the first positioning system 110 to the second positioning system 150 and contains three linear bearings 123 for guidance of the inter-stage pusher rods 148. Plate 122 provides support for both the inside tube 121 and the cylinder tube 160 which is held in place by four tensioned tie rods (not shown) between the intermediate plate 122 and the head assembly 190.

Figure 3:
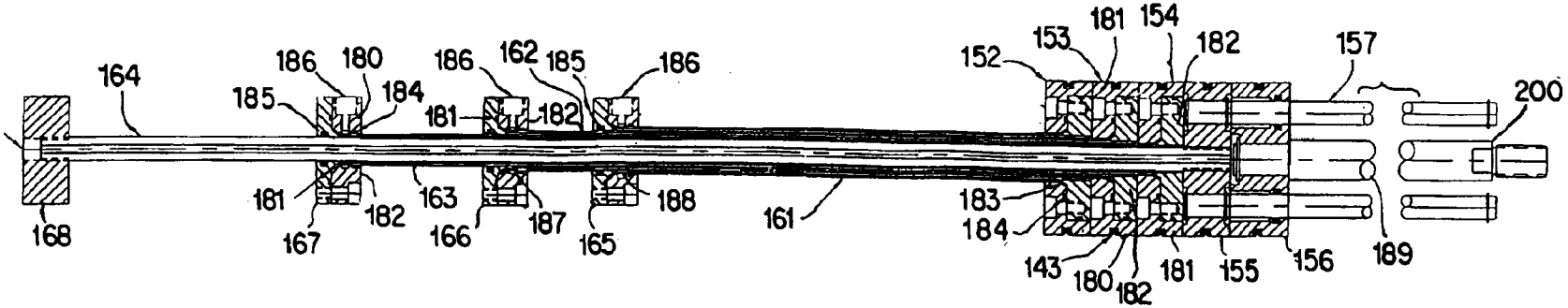
FIG. 3 illustrates the second positioning system according to the embodiment shown in FIG. 1 at rest, without the cylinder.

FIG. 3 illustrates a sub-assembly of the pistons of the second positioning system without cylindrical housing 120, the pistons of the first positioning system and cylinder 160. FIG. 3 shows four power pistons 153, 154, 155 and 156 at rest in their fully retracted positions against the fractional piston 152 and four concentric, co-axial conduits or tubes 161–164. The retraction force produced by the low pressure line air works against the reduced effective area of the retract piston 156 which is the result of using an oversized piston rod 189 having one-half or less the surface area of the advancement pistons 152–155. Tubes 161–164 tether each of the pistons 153–156 to a respective one of the stroke limiting collars 165–168 and limit their distances to those discussed herein. Tubes 161–164 are formed of rigid material such as aluminum, brass, steel or any high strength plastic such as delrin, nylon, etc. The rigidity of the tubes contributes to the ability of cylinder 100 to resist lateral and torsional forces applied during its operation.

Each concentric tube 161–164 is sized so that its outside diameter is sufficiently smaller than the inside diameter of the tube in which it moves to provide an annular cross-sectional area large enough to convey the high pressure fluids, such as air, rapidly to the next succeeding cavity. The wall thickness of each tube is carefully sized to ensure that its strength is sufficient to withstand the tensile and compressive forces it will encounter during the operation of the multi-stroke cylinder 100. These wall thicknesses can vary depending on the intended use of the cylinder 100, the materials of the tube and/or the magnitude of the forces that will be applied to the tube. In a preferred embodiment, the wall thickness of each tube 161–164 can be substantially 1/32 inch or 1/8 inch. Alternatively, the thickness can be between 1/32 inch and 1/8 inch. The advantages of using coaxial tubes 161–164 include less friction, fewer sealing problems, simpler inter-stroke stop mechanisms, reduction in off-center piston loads and increased stability.

High pressure compressed air is introduced through collars 165–168 and channeled between pistons 152–156 by tubes 161–164. The outside and shortest tube 161 rigidly connects the fractional stroke piston 152 to the collar 165. Collar 165 channels high pressure air between tubes 161 and 162. This air travels through the fractional stroke piston 152 to move the piston 153. Similarly, the tube 162 connects the piston 153 to the collar 166 which channels compressed air between tubes 162 and 163, which in turn introduce the compressed air between pistons 153 and 154. The air between pistons 153 and 154 moves piston 154 away from piston 153. Tube 162 is dimensioned in length to limit movement between the fractional piston 152 and the piston 153 to a precise, predetermined length such as one inch. In this same manner, the stroke limiting collar 167 supplies compressed air between tubes 163 and 164 for contacting and moving piston 155 away from piston 154. Compressed air is supplied to piston 156 through stroke limiting collar 168 which is tapped, as is piston 155, to receive the much heavier walled center tube 164 which provides structural support to the entire tethering, co-axial tube sub-assembly. The piston 156 is tethered to the piston 155 through a plurality of the steel shafts 157 which allow precisely eight inches of movement between the two pistons 155, 156.

As shown in FIG. 3, the pistons 152, 153 and 154 and stroke limiting collars 165, 166 and 167 which contain tubes 161–163, respectively, each include an assembly 180 having two pieces 181, 182 formed to complement, capture and retain the flared ends 183 of their respective tubes. Two O-ring static seals 184 within each assembly 180 prevent fluid leakage and each two-part, stroke limiting collar 165–167 contains a dynamic seal 185 to prevent leakage between it and the outside wall of the tube on which it slides.

Conventional NPT entry ports 186 located in each of the two-part collars 165–167 channel the line air into a connecting radial cavity 187 which distributes it through several holes 188 in its associated fluid supply tube to allow flow into the space between adjacent tubes.

The piston rod 189 is secured to piston 156 and is capable of being rotated within piston 156 so that outside torque forces are not be transmitted to the internal mechanisms which link pistons 155–156 to each other.

Figure 7:
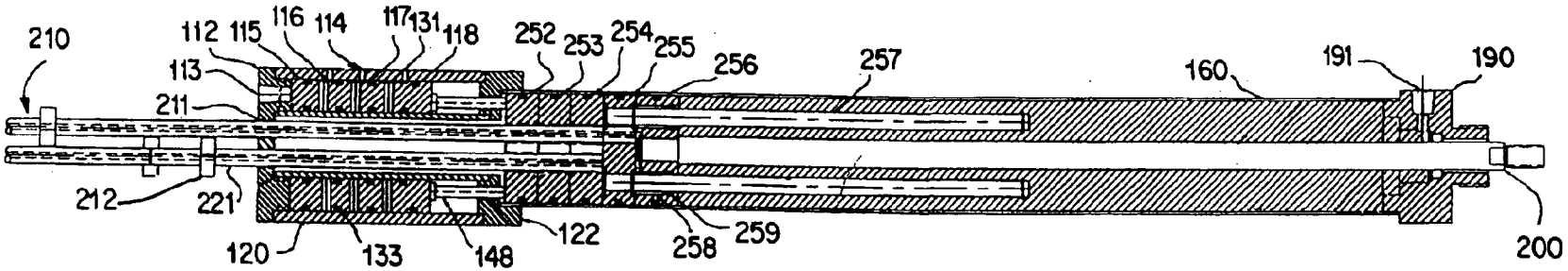
FIG. 7 is a schematic view of a multi-stroke cylinder according to another embodiment of the present invention.

An alternative form of tethering the pistons is illustrated in FIG. 7. The same reference numerals are used to indicate common elements between the embodiment shown in FIG. 1 and that shown in FIG. 7. In FIG. 7, the inlet tubes 210 are not concentric with one another. Instead, each extends through one of four linear bearings 211 mounted in a square array within rear plate 112. A stroke limiting collar 212 is rigidly attached to tube 221 about one inch outside rear plate 112 when the pistons are in their retracted position. The spacing between this collar 212 and plate 112, as well as the length of pusher rods 148, allows a fractional stroke piston 252, attached to tube 221, to move a full 15/16 of an inch. Tube 221 extends into fractional stroke piston 252 but does not pass through it. Instead, tube 221 stops at a face of piston 252 closest to piston 253.

Figure 8:
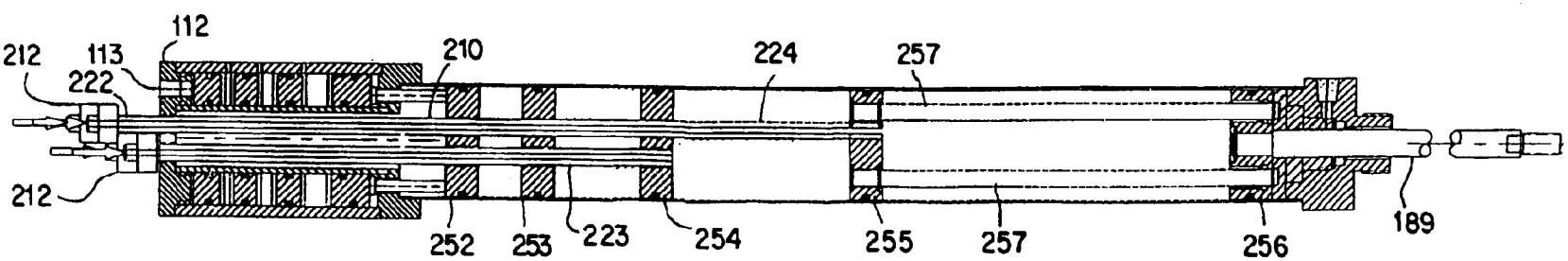
FIG. 8 is a schematic view of the multi-stroke cylinder shown in FIG. 7 with the stages in an extended state.
Figure 9:
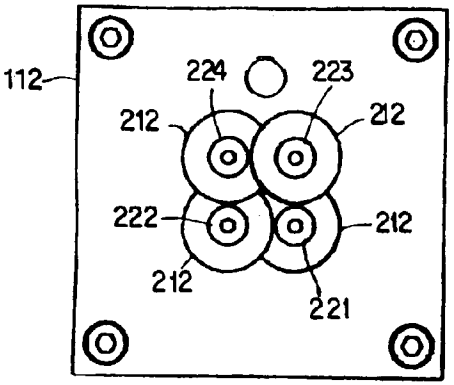
FIG. 9 is an end view of the multi-stroke cylinder according to FIG. 7.

The three remaining tubes 222, 223, 224, all similar to tube 221, pass through seals 230 and bearings 231 mounted in a square array within fractional stroke piston 252. The square array of fractional stroke piston 252 is substantially identical to that of plate 112 so that the tubes remain straight as they extend along the length of the multi-stroke cylinder. Tube 222 is attached to the 1" stroke piston 253 and the other two tubes 223, 224 pass through a bearing in piston 253 and are attached to the 2" stroke piston 254 and the 4" stroke piston 255, respectively. Like tube 221, tubes 222–224 have collars 212 rigidly attached at precise positions along their lengths so the collars on adjacent shafts contact one another, as shown in FIG. 8, and limit the relative movement between the adjoining shafts and adjacent pistons. In this manner, collar 212 is positioned on tube 222 so the movement of the 1" stroke piston 253 relative to the fractional stroke 252 piston is limited to one inch. Collar 212 is positioned on tube 223 so the movement of the 2" stroke piston 254 relative to the 1" stroke piston 253 is limited to two inches. Collar 212 is positioned on tube 224 so stroke piston 255 only moves four inches relative to 2" stroke piston 254.

Figure 10:
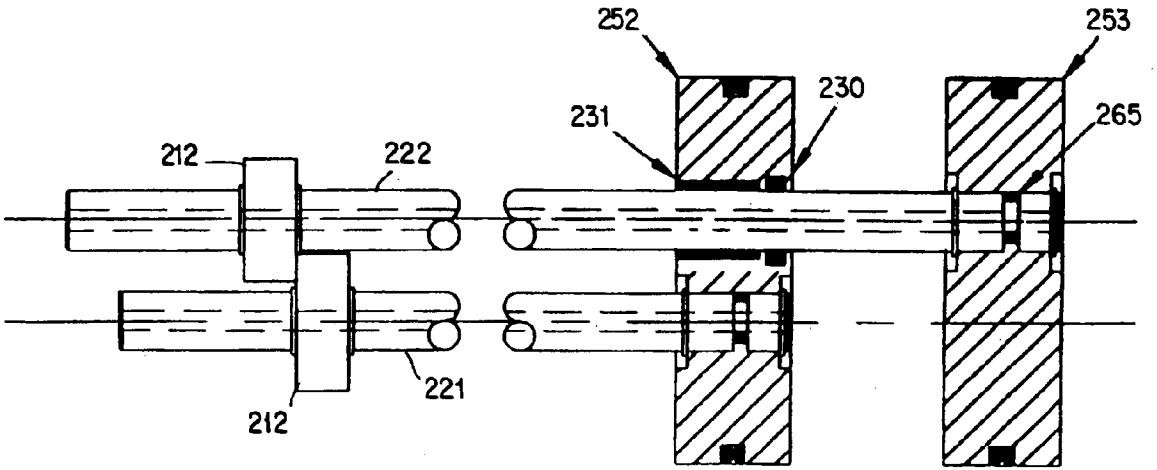
FIG. 10 illustrates the connection between the pistons and fluid supply tubes of the embodiment shown in FIG. 7.

Each of the hollow tubes 221–224 are attached to a high pressure fluid source for introducing air between adjacent pistons. Tube 221, attached to the fractional stroke piston 252 supplies air between stroke pistons 252 and 253 to move stroke piston 253 one inch; tube 222, attached to the 1" stroke piston 253, supplies air between stroke pistons 253 and 254 to move the 2" stroke piston 254 two inches; and tube 223, attached to the 2" stroke piston 254, supplies air between stroke pistons 254 and 255 to move stroke piston 255 four inches. The 8" stroke piston 256 is moved by the fluid supplied between stroke pistons 255 and 256 through tube 224 attached to the 4" stroke piston 255. As with tube 221, tubes 222–224 terminate at the face of the piston to which they are attached. The relative movement of piston 256 with respect to piston 255 is limited by a pair of stroke limiting shafts 257 which are rigidly attached to the 4" stroke piston 255 but pass through the 8" stroke piston 256 via bearings 258 and seals 259. The piston rod 189 is capable of being rotated within stroke piston 256 so that outside torque forces cannot be transmitted to the internal mechanisms which link the floating pistons to each other. FIG. 10 depicts the stroke limiting action of the collars 212 between the fractional stroke piston 252 and the 1" stroke piston 253 as they would appear if removed from the confining cylinder. Linear bearings 231 and dynamic tube seals 230 provide low friction, leak proof, relative movement between the air supply tubes and the monolithic pistons. O-rings 265 provide hermetic seals where the tubes are attached to the pistons as shown in FIG. 10.

When high pressure air is vented from the space between any two of the pistons, the retraction force of the low pressure air (shown by hatching in FIG. 7) in cylinder 160 between head assembly 190 and piston 156 causes piston 156 to move toward the rear plate 112. The force of the low pressure air expels the residual air between the two adjacent pistons and moves the pistons and the piston rod 189 inward from their extended positions as shown in FIG. 8. The pistons and piston rod 189 move an amount equal to the length of the distance between them. The air is vented to the atmosphere through the exhaust port in the three-way valve which supplies high pressure air to the various pistons. Low pressure air returns between piston 256 and head assembly 190 through fluid port 191. A self compensating type of pressure reducer is used to return the lower pressure fluid between piston 256 and the head assembly 190.

A co-axial multi-stroke cylinder 100' according to another embodiment of the present invention is illustrated in FIGS. 11–16. This embodiment utilizes coaxial cylinders for housing its piston rod positioning systems. Elements of this embodiment that are similar to those previously described will be identified using the same numerals. The embodiment shown in FIG. 11 eliminates the need for low pressure air to retract a piston rod 189'. Instead, this embodiment takes advantage of line air for cylindrical and piston rod retraction.

With all of the embodiments discussed herein, the use of line air operating against smaller piston areas has the advantage of not requiring a self-relieving pressure reducing valve which increases system costs and plumbing complexity. Also, the prior art systems which use air must vent their air to the atmosphere when any of the pistons advance. Line air is not vented from the system but is pumped back into the supply line by the advancing pistons, thus saving the costs of producing compressed air—a fairly expensive commodity in an industrial plant. By including a three-way valve to handle the line air used for retraction, one could remotely vent this air and thereby effectively double the push power of the cylinder should the occasion arise.

Figure 11:
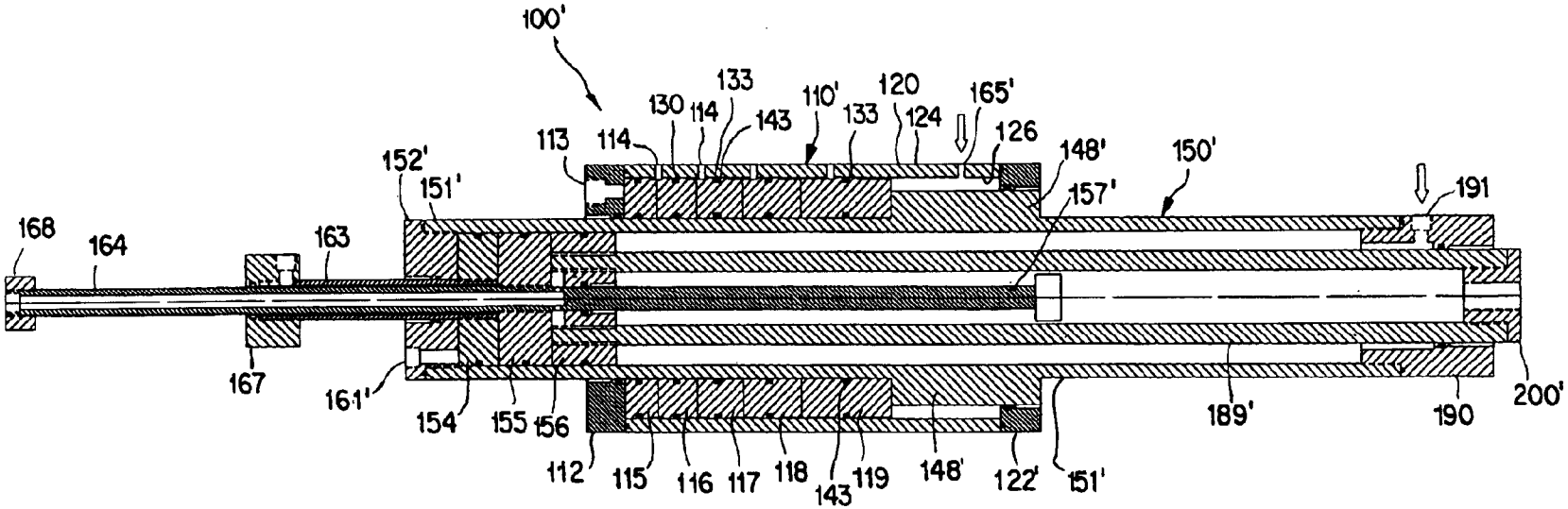
FIG. 11 is a schematic view of another embodiment of the multi-stroke binary cylinder according to the present invention.
Figure 13:
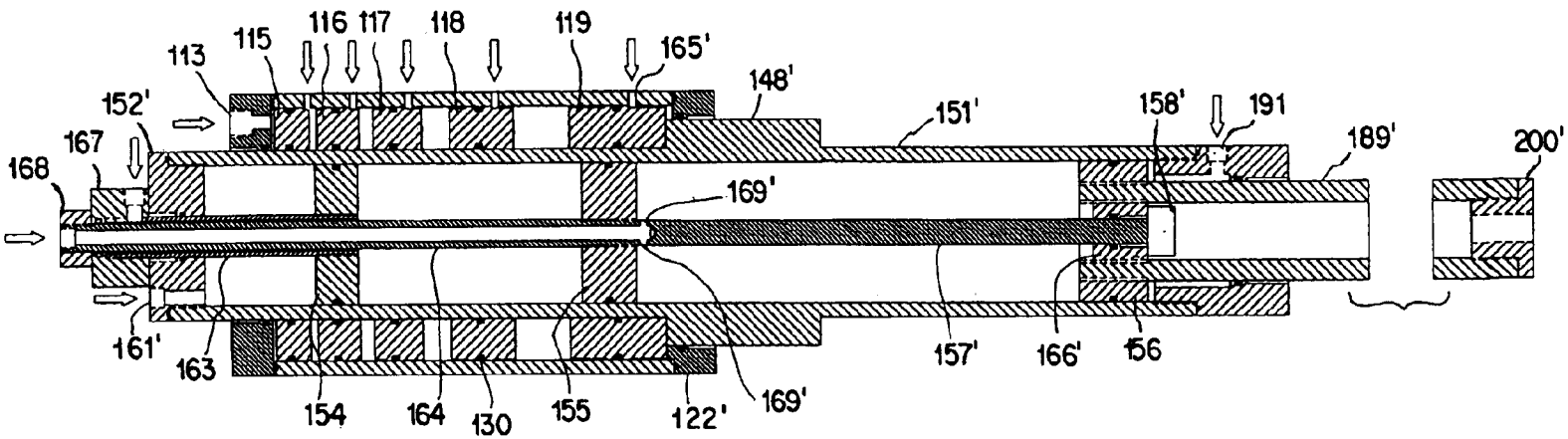
FIG. 13 is a schematic view of the multi-stroke cylinder of FIG. 11 with the stages of the first and second positioning systems in an extended stroke.

As illustrated in FIG. 11, cylinder 100' includes first positioning system 110' and second positioning system 150'. As with the multi-stroke cylinders discussed above, common elements have the same reference numerals as used with the description of the previous embodiments. The total stroke length of cylinder 100' is 15 and 15/16 inches. However, the individual stroke lengths of each positioning system 110' and 150' are different from those discussed above. Contrary to the multi-stroke cylinders discussed above, first positioning system 110' is capable of moving piston rod 189' a total of 1 and 15/16 inches. Second positioning system 150' is only capable of moving piston rod 189' a total of 14 inches. Nevertheless, the combined total possible stroke length of cylinder 100' is 15 and 15/16 inches when the cylinder has been fully extended as shown in FIG. 13.

Figure 14:
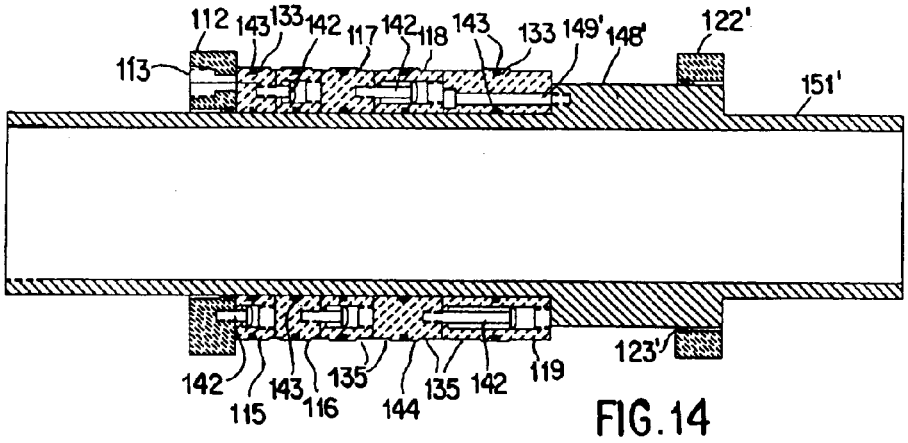
FIG. 14 is a schematic view of the tethered pistons of the first positioning system and second positioning system housing.
Figure 15:
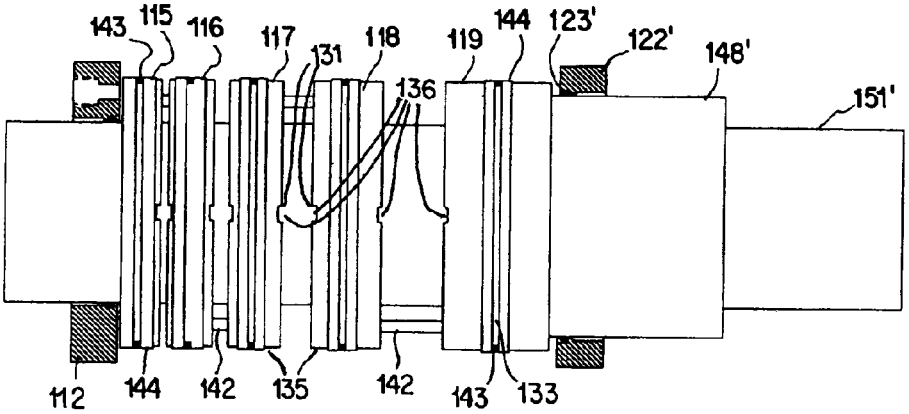
FIG. 15 shows the pistons of the first positioning system about the second positioning system housing.

First positioning system 110' operates in a similar manner to that discussed above with respect to positioning system 110. First positioning system 110' includes annular cylindrical housing 120 surrounding a plurality of pistons 115–119. Housing 120 includes an outer surface 124 and an inner surface 126. Input port orifices 114 extend between surfaces 124 and 126 for introducing compressed air from a conventional source into housing 120 and between pistons 115–119. As discussed above, conventional three-way solenoid or pilot operated valves can be used with the embodiments of the present invention. Such valves which are able to be used with each embodiment described herein are produced by companies such as MAC valves, ASCO, Humphrey and Parker Hannifin. As shown in FIGS. 14 and 15, pistons 115–119 each include a seal 143, positioned in slot 133, that engages with inner surface 126 to prevent the introduced air from passing between each piston 115–119 and inner surface 126. Pistons 115–119 also include an inner seal 143 for engaging the outer surface of a housing 151' of second positioning system 150'. Tethering members 142 are used to limit the travel of pistons 115–119 relative to each other and back plate 112, as discussed above. Like piston 153 of second positioning system 150, piston 119 has a total stroke length of one inch. This one inch, when added to the combined 15/16 of an inch stroke of pistons 115–118, provides positioning system 110' with its total stroke length of 1 and 15/16 inches.

Figure 12:
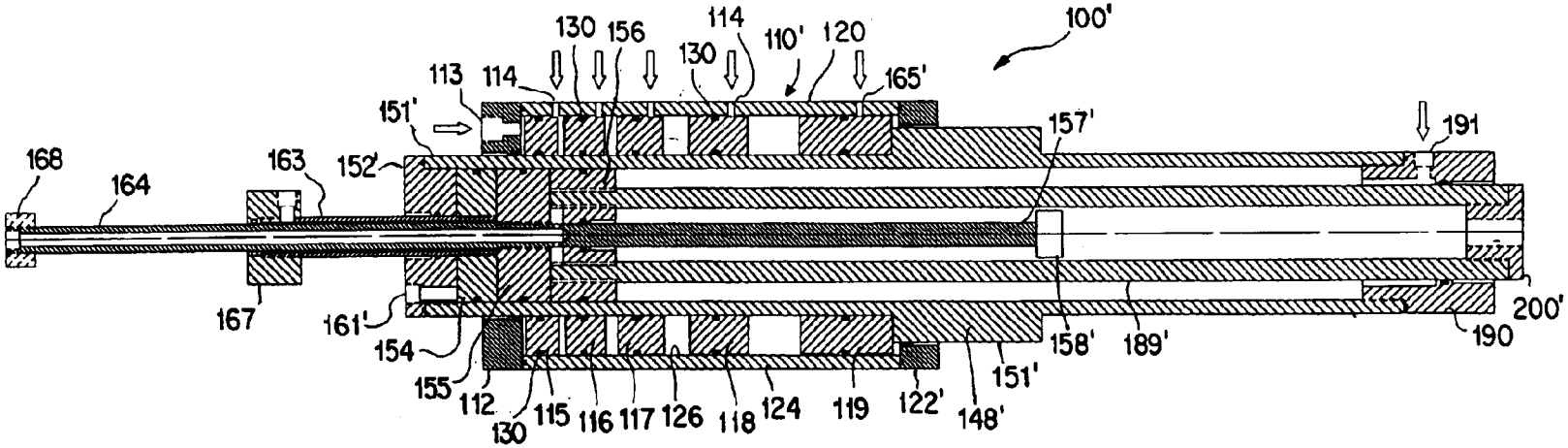
FIG. 12 is a schematic view of the multi-stroke cylinder shown in FIG. 11 with the stages of the first positioning system in an extended state.

Second positioning system 150' operates in a similar manner to that discussed above with respect to positioning system 150. Second positioning system 150' includes housing 151', a rear plate 152' and a plurality of power, stroke pistons 154–156 for imparting movement to piston rod 189'. As seen in FIGS. 11–13, housing 151' has an elongated, generally tubular shape that extends within and through housing 120 such that they are coaxially aligned and mutually supported. This overlapping, coaxial positioning of housings 120 and 151' forms a more stable multi-stroke cylinder when compared to those of the prior art. The overlapping, coaxial positioning of the housings also creates a compact, multi-stroke cylinder 100' that does not occupy as much space, when activated and when at rest, as prior art multi-stroke cylinders. The multi-stroke cylinder 100' is more compact and better able to resist the forces created when piston rod 189' moves. The present invention eliminates the conventional back to back piston relationship used in the prior art. The coaxial positioning also makes the cylinder easier and less costly to manufacture when compared to conventional multi-stroke cylinders.

Housing 151' includes a raised, first positioning system engaging portion 148' that transfers the cumulative stroke of pistons 115–119 from first positioning system 110' to second positioning system 150' and to piston rod 189'. As shown in FIG. 14, piston 119 is secured to the engaging portion 148' by a plurality of fastening screws 149'. The engaging portion 148' passes through a guide bushing and kinetic seal 123' in plate 122' and reduces the effective area of the return side of piston 119 to provide the force differential needed to extend and retract housing 151' relative to housing 120. The engaging portion 148' can be varied in diameter from model to model to provide modest variations in the ratio between the forces needed to extend and retract the cylinder. Piston 154 is moved by introducing a high pressure fluid through input port 161' and between back plate 152' and piston 154. Pistons 155 and 156 are moved by the introduction of fluid via tubes 163 and 164, as discussed above. Tube 164 passes through a guide bushing/seal arrangement in stroke limiting collar 167. As with those discussed above, this seal arrangement, shown in FIG. 13, prevents the escape of fluid within tube 163 from between collar 167 and the outer wall of tube 164.

After the pressurized fluid exits tube 164 through openings 169', it forces hollow piston rod 189' and rod cap 200' a distance of eight inches away from piston 155. Piston rod 189' is secured to piston 156 so that no relative movement exists therebetween. As shown in FIG. 13, an eight inch tethering rod 157' extends through a guide bushing and a kinetic seal contained within an insert 166' at the end of hollow piston rod 189' where it is secured to piston 156. Tethering rod 157' includes a tethering head 158' for contacting the insert 166' in order to limit the movement of the piston rod 189'. Piston rod 189' includes a hollow center for receiving tethering rod 157' when piston 156 is in contact with piston 155, such as when the cylinder 100' is at rest, as shown in FIG. 11. Cylinder 100' is compact and space efficient, in part, due to the piston rod 189' receiving tethering rod 157 while the cylinder 100' is at rest. Low pressure air is introduced into ports 165' and 191 for returning the advanced pistons to their rest positions.

FIG. 15 shows an external view of the same pistons in the extended mode. These pistons are slightly reduced in diameter on one or both sides of the full diameter section 144 which contains the seal slots 133 and kinetic seals 143. This arrangement allows full flow of air in and out of the cavities between the pistons 115–119 to the various ports 114 as the pistons 115–119 move relative to these ports 114 within the cylinder walls. The reduced diameter sections 135 provide the same function as the parallel slots 131 shown in FIGS. 5 and 6 but allow the input ports 114 to be placed at any convenient position around the circumference of the piston. As discussed above, shallow lateral slots 131 machined at multiple places across the face of each piston allow quicker movement of compressed air between adjoining pistons as they separate or come together.

Figure 16:
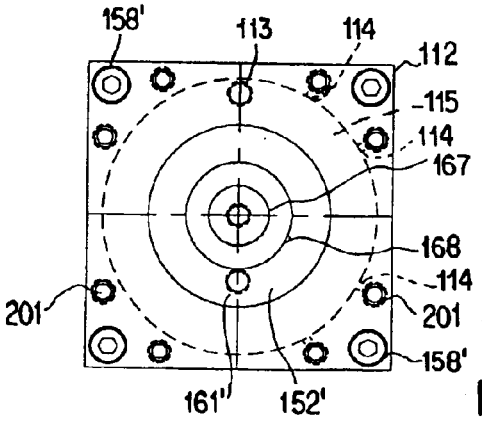
FIG. 16 shows a surface of the back plate according to the embodiment shown in FIG. 11.

FIG. 16 shows an end view of the top of the cylinder with the 1/16 inch stroke port 113 at top. Also shown are the 2 inch stroke stop 168, the 4 inch stroke stop 167 and the 2 inch stroke port 161'. Four screws 158' attach the rear end plate 112 to the housing 110. Up to eight tapped input ports 201 conduct compressed air axially through the solid portions of the housing to connect with radial ports 114 located between adjacent pistons or to other ports machined into the forward plate 122. This approach simplifies the complicated plumbing of conventional cylinders and is made possible by the reduced diameters 135 on the outside of the annular pistons as described heretofore.

Figure 17:
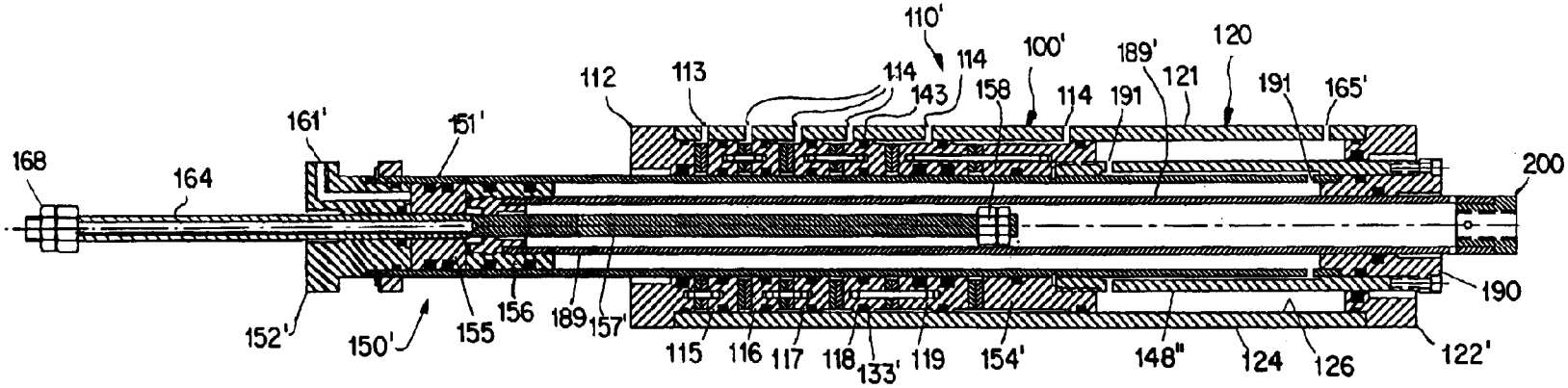
FIG. 17 is a schematic view of another embodiment of the multi-stroke cylinder of FIG. 17 with both positioning stages in their fully retracted states, according to the present invention.

FIG. 17 illustrates another embodiment of a multi-stroke cylinder 100" that is similar and operates in essentially the same manner as the multi-stroke cylinder 100' shown in FIG. 11. As a result, a discussion of its components that are also included in cylinder 100' and its operation will not be repeated. Contrary to the embodiment of FIG. 11, the two inch stroke piston 154', according to this embodiment, is housed in the first positioning system 110". As a result, the second positioning system 150" only includes two pistons 155, 156 and one fluid introduction tube 164. First positioning system 110" has a total stroke length of 3 and 15/16 inches. Second positioning system 150" has a total stroke length of only twelve inches. FIG. 17 schematically illustrates the multi-stroke cylinder 100" in a fully retracted condition. This embodiment is easier, more compact, more stable and more economical to manufacture when compared to conventional cylinders. Also, as with the embodiment shown in FIGS. 1 and 11, this embodiment is more accurate and better able to resist the forces created during its operation.

Figure 18:
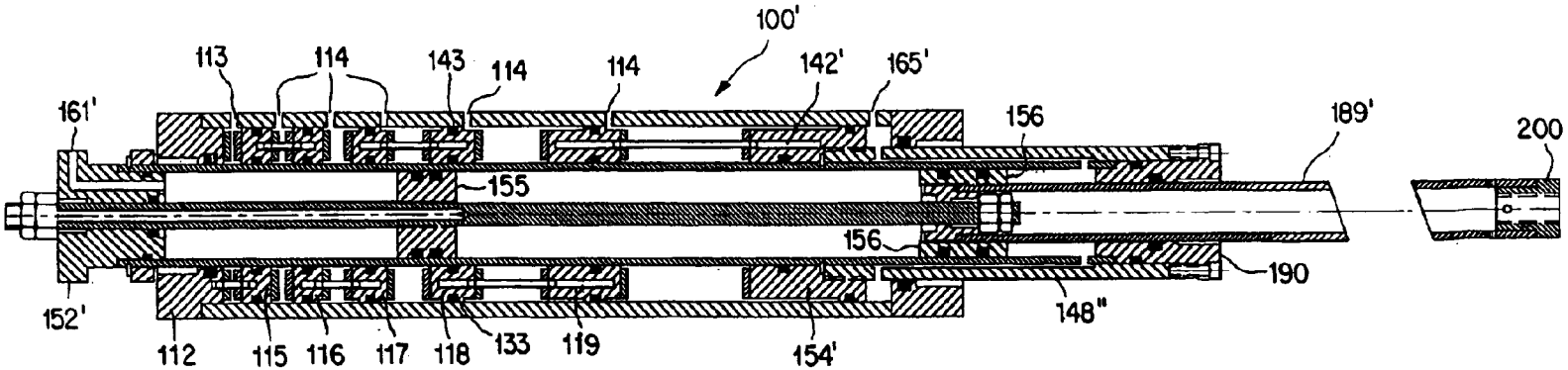
FIG. 18 is a schematic view of the multi-stroke cylinder shown in FIG. 17 with both positioning stages in their fully extended states.

The multi-stroke, hydraulic cylinder 100" is shown in FIG. 18 with all of its stages extended. This invention utilizes floating, tethered pistons, interconnected in such a manner as to cause an output piston rod 189 to move a distance equal to the sum of all the distances moved by each of the individual, activated pistons. The first positioning system 110" includes six annular pistons 115, 116, 117, 118, 119 and 154' having respective stroke lengths of 1/16", 1/8", 1/4", 1/2", 1" and 2" which operate within annular cylindrical housing 120. The first positioning system is thus capable of stroking 3 15/16" in increments of 1/16". The second positioning system 150", extending within the first positioning system, includes two conventional pistons 155 and 156 having respective stroke lengths of 4" and 8" and is thus capable of stroking 12" in increments of 4". The 2" stroke piston 154' is rigidly attached to the second stage cylinder tube 151' and to the steel extension tube 148" which acts to guide it through the head plate 122' of the first positioning system as its pistons 115–119, 154' advance and retract. The piston 154' can be integrally formed with the extension tube 148" as a single unit. The outside diameter of the extension tube 148" is sized so that the area left between it and the inside diameter of the annular cylinder 121 approximately one-half the face area of the other annular pistons 115–119, 154'. As a result of this size relationship, compressed air at line pressure acting against this area creates a retraction force against the extended 2" stroke piston 154' which forces all the first stage pistons 115–119, 154' to the rear of plate 112 of the annular cylinder 121. The piston tube 189 of the second stage is sized in a similar manner with respect to piston 156 so that line pressure acting on the retraction face of the 8" stroke piston 156 forces it against the 4" piston 155 and pushes both to the rear of the second stage cylinder tube 151'. Air orifices 191 placed near the left end of the extension tube 148" and the right end of the second stage cylinder tube 151' allow compressed air to flow in and out of the retraction sides of both cylinders, thus maintaining constant retraction forces regardless of the positions of the pistons within the two cylinders.

The introduction of line air through a port 113 or a port 114 between any two pistons will create extension forces that are approximately twice those of the retraction forces needed to return the extended pistons to rest as discussed above. The extension forces cause the affected piston to move toward the head of its respective cylinder (rightward as shown in FIG. 18) the precise distance allowed by the inter-piston tethering mechanisms.

Figure 19C:
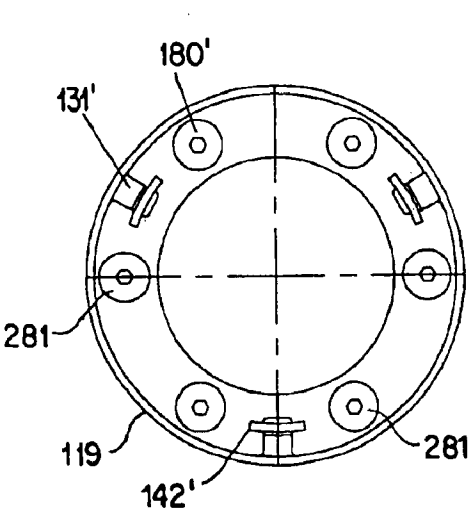
FIGS. 19A–C schematically illustrate a stroke piston as shown in FIG. 17.
Figure 19B:
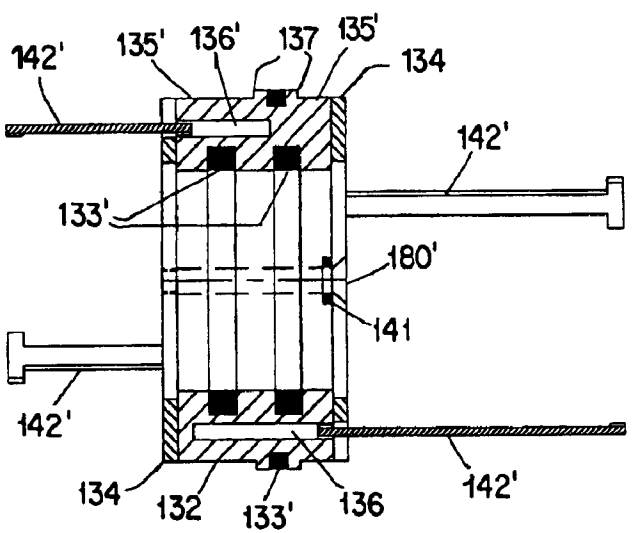
Figure 19A:
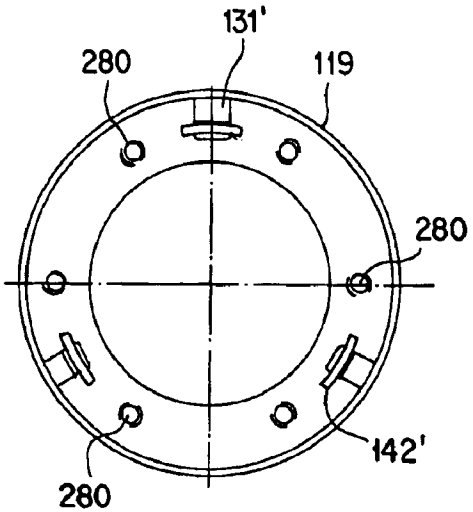

FIGS. 19A–C illustrate the construction details of the 1" stroke piston 119 which is typical of the fractional movement annular pistons 115–119, 154'. The piston body 132 would typically be fashioned of an easily machined metal, such as aluminum, or a plastic, such as delrin. The piston 119 includes three or more slotted wells 136' machined into each piston face at regular intervals and of sufficient depth to accommodate approximately one half the length of I-shaped metal tethers 142' which link it to the pistons on either side 118, 154'. Flat steel rings 134, fastened to both faces of the piston body by multiple through-bolts 180' as shown in FIGS. 19A–C, contain three or more matching rectangular slots 131' which are aligned with the piston body wells and capture the T-shaped ends of the metal tethers 142', which precisely limit the movements of the various pistons relative to one another and ensure that the piston faces are maintained parallel to each other in the tethered positions. These flat steel rings 134 also prevent the end faces of their respective pistons from being damaged (scratched, broken, nicked, etc.) by an adjacent piston. They also prevent the forces applied by the tethers 142' from damaging the end faces of their respective pistons. The tethers 142' are formed from relatively thin, heavy, high strength, heat treated sheet metal stampings with a slight curvature about their long axes for extra rigidity. The thin cross section of these tethers 142' allow a thinner walled, annular piston and, therefore, greater compactness in overall design. Additionally, the tethers are contained in wells 136' when the pistons are in a retracted position for additional compactness of the air or hydraulic cylinder 100". A plurality of bolt holes 280 extends through each piston and its rings 134 for securing the portions of the piston together. O-rings 141 are installed beneath a bolt head 281 to prevent the passage of air through the bolt holes 280 and preserve the pneumatic integrity of each piston. The outer cylindrical surface 135' of each piston body, on one or both sides 137 of the outer sealing slot lands carrying dynamic seal 133', is stepped down in diameter in order to provide a passageway 135 for compressed air to move into and out of the piston actuating area regardless of the respective piston's movement or position. As discussed above, dynamic seals 133' on both the inner and outer diameters of each piston 115–119, 154' prevent passage of compressed air past the piston as it moves back and forth within the containing cylinder 121.

Figure 20:
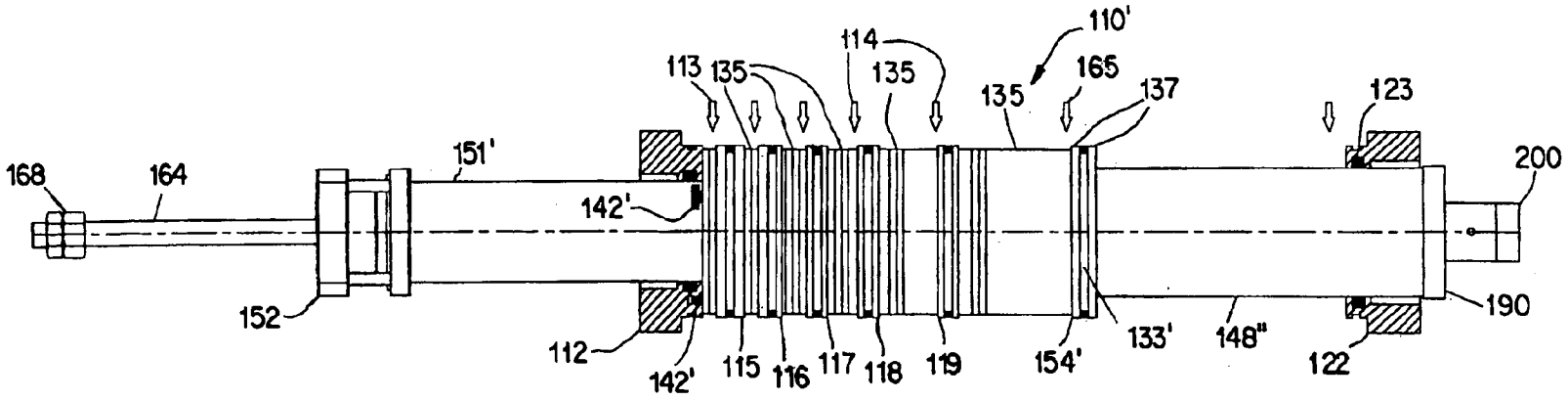
FIG. 20 illustrates the first stage positioning system with all pistons in their retracted positions as shown in FIG. 17 but with the cylinder wall removed for better clarity.

FIG. 20 depicts the first stage positioning system 110" without the enclosing cylinder tube 121 and with all pistons fully retracted against the rear housing plate 112. The tip ends of the 1/16 stroke piston tethers 142' appear to the left of the 1/16" piston 115. Compressed air entry ports 113 and 114 for actuation of the six annular pistons 115–119, 154' are represented by arrows and are positioned just to the rear (left as shown in FIG. 20) of the dynamic seal lands 137 for each piston.

Figure 21:
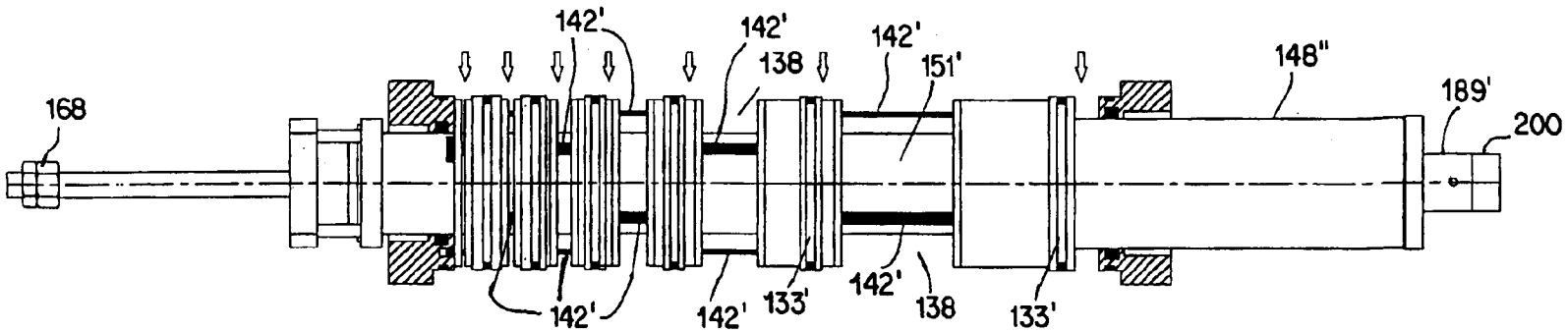
FIG. 21 illustrates the first stage positioning shown in FIG. 20 but with all pistons in their extended positions.

FIG. 21 illustrates the first stage positioning system shown in FIG. 20 with all six pistons extended to the limits allowed by their tethers 142'. The overall piston length is designed to provide adequate depth for containing the associated tethers 142' within their slotted wells 136'. The width and placement of the lands 137 and seal grooves 133' are designed to provide adequate lengths for the reduced diameter sections 135 so that compressed air can flow unimpeded through the side input orifices 113, 114 and 165 to and from the piston cavities 138 regardless of the position of the pistons within the confining cylinder.

Figure 22:
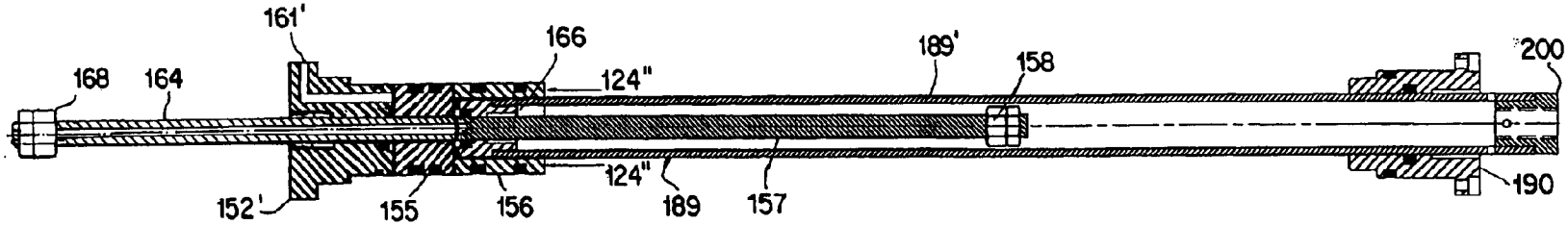
FIG. 22 is a schematic view of the second stage positioning system with both the 4" stroke and the 8" stroke pistons in their retracted positions but with the cylinder wall removed for better clarity.
Figure 25:
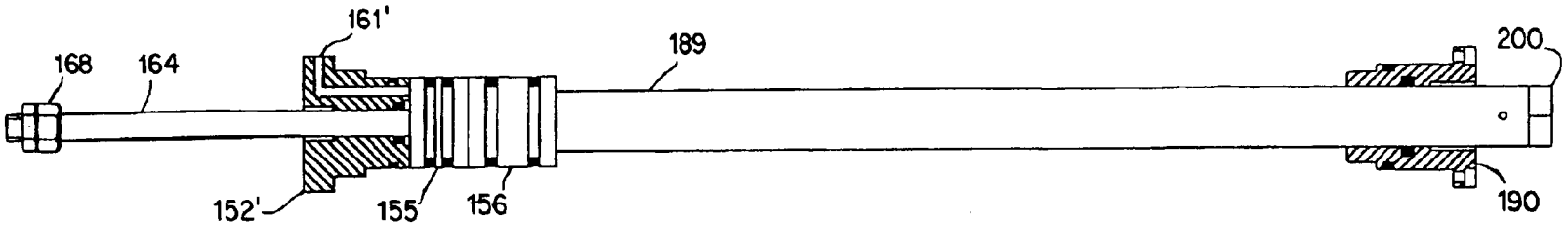
FIG. 25 schematically illustrates the second stage positioning system shown in FIG. 23 with the enclosing cylinder tube removed.

FIGS. 22 and 25 schematically illustrate the second stage positioning system 150" without the confining cylinder tube 151' and with both the 4" stroke piston 155 and the 8" stroke piston 156 forced into their fully retracted positions by line air pressure 124" working against the right hand face (as seen in FIG. 22) of the 8" stroke piston. FIG. 22 illustrates the second stage positioning system 150" in cross section and the direction of the effective air pressure.

Figure 23:
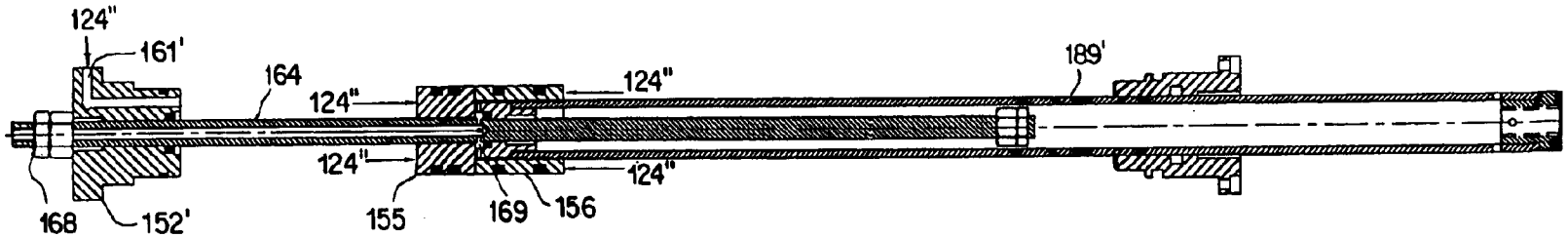
FIG. 23 illustrates the second stage positioning system shown in FIG. 23 but with the 4" stroke piston in its extended position.
Figure 26:
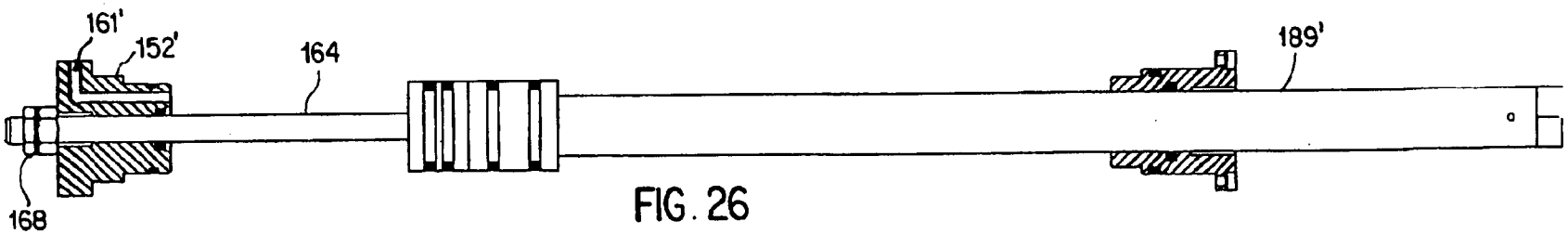
FIG. 26 schematically illustrates the second stage positioning system shown in FIG. 24 with the enclosing cylinder tube removed and the 4 inch stroke piston extended.

FIGS. 23 and 26 depict the second stage positioning system shown in FIG. 22 as it would appear with line air pressure 124" entering through orifice 161' and working against the left hand face of the 4" stroke piston 155 thus forcing both 4" stroke piston 155 and 8" stroke piston 156 outward (rightward as seen in FIG. 23) the precise 4" allowed by the adjustable tethering stop nuts 168. FIG. 23 illustrates the second stage positioning system 150" in cross section and the direction of the effective air pressures.

Figure 24:
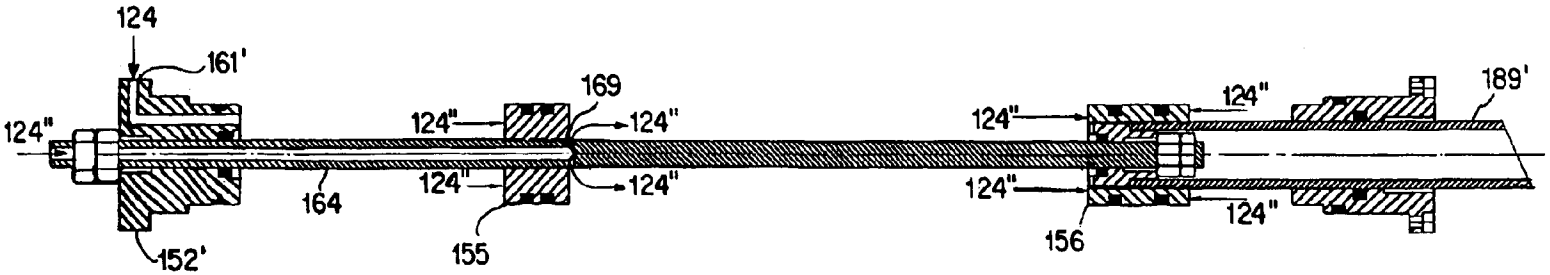
FIG. 24 illustrates the second stage positioning system shown in FIG. 24 but with both the 4" stroke and the 8" stroke pistons in their extended positions.
Figure 27:
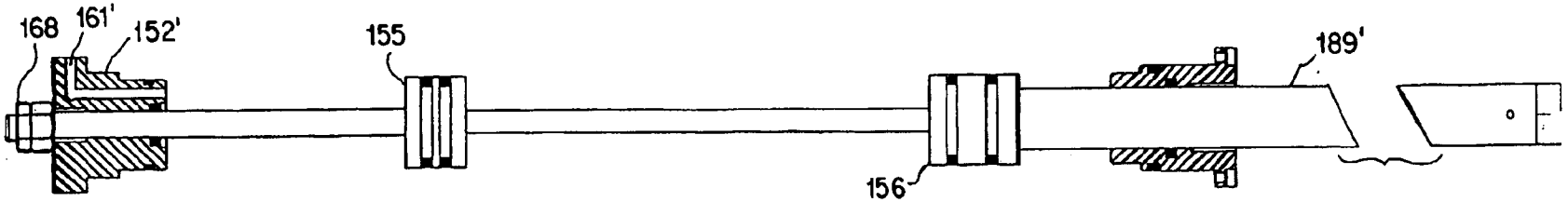
FIG. 27 schematically illustrates the second stage positioning system shown in FIG. 25 with the enclosing cylinder tube removed and with both the 4 inch and 8 inch stroke pistons extended.

FIGS. 24 and 27 depict the second stage positioning system shown in FIGS. 22 and 23 with line air pressure flowing through the air supply tube 164 and orifices 169 into the cavity between the 4" stroke piston 155 and the 8" stroke piston 156. This cavity or space is eventually vacated by the 8" stroke piston 156 as the pistons 155, 156 separate. The tethering stop nuts 158 provide a lockable adjustment for precisely setting the 8" tethered travel between the 4" stroke piston 155 and the 8" stroke piston 156. Other well known adjustable locking members could also be used. FIG. 24 illustrates the second stage positioning system 150" in cross section and the direction of the effective air pressures.

Figure 28:
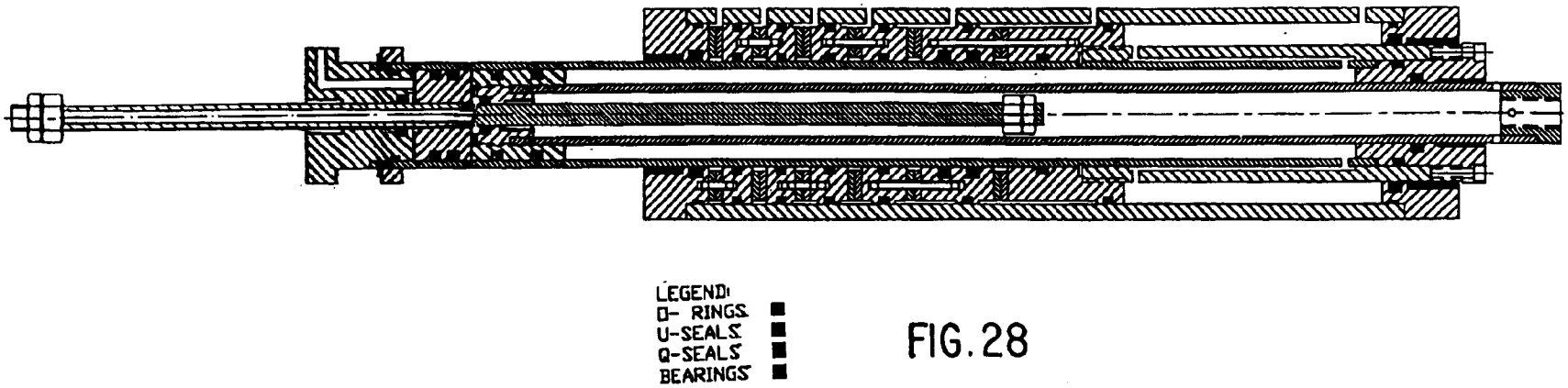
FIG. 28 illustrates the multi-stroke cylinder as shown in FIG. 18 but with a color coded Legend which shows the placement of the various seals and bearings.

FIGS. 28 illustrate the multi-stroke cylinder of FIG. 18 but with a color-coded Legend which shows position of the various static O-ring seals, linear motion bearings, U-cup type dynamic seals and Quad Ring type dynamic seals.

Figure 29A:
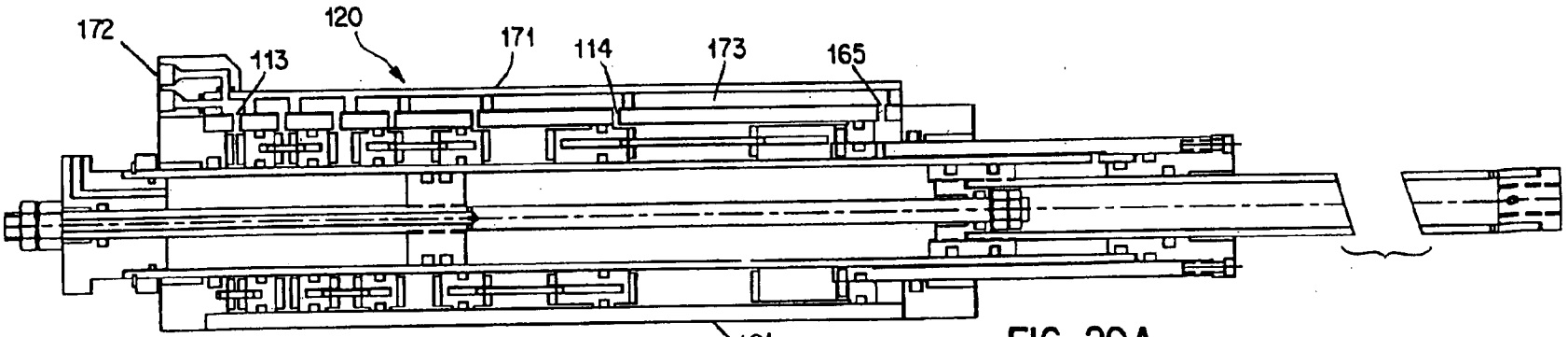
FIGS. 29A and 29B illustrate the multi-stroke cylinder shown in FIG. 18 but with the input air manifold assembled to the top of the main housing.
Figure 29B:
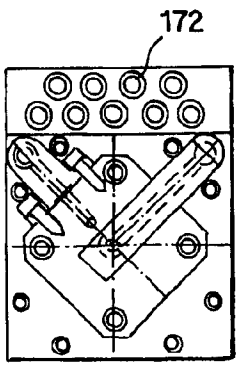

FIG. 29A illustrates the multi-stroke cylinder of FIG. 17 with the air distribution manifold assembly 170 mounted in position atop the annular cylinder 121 housing. FIG. 29B depicts an end view of the cylinder in FIG. 29A with the nine air input connections 172 which channel compressed air between the eight individual pistons and the back plate 112, and to the return air chambers in the front of the two cylinders (right side as shown in FIG. 29A).

Figure 30:
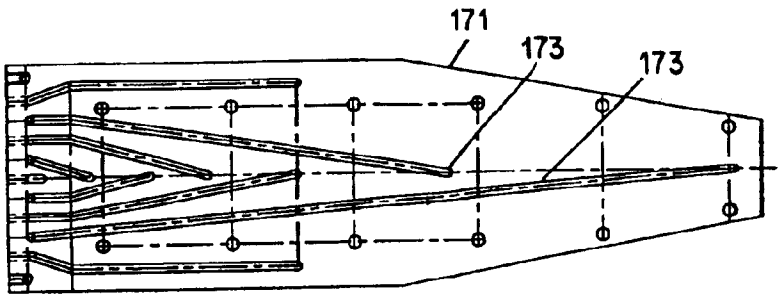
FIG. 30 depicts a bottom view of the air input manifold plate showing the grooves which channel compressed air from the plumbing connections to the piston input orifices atop the main housing.
Figure 31:
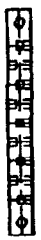
FIG. 31 is an end view of the air input manifold plate of FIG. 30.

FIG. 30 depicts a bottom view of air input manifold plate 171 showing the grooves 173 which channel compressed air from the plumbing connections 172 to the orifices 113, 114 atop the annular cylinder housing 121. These air flow grooves can be formed by any well known procedure such as machining.

The following description applies to the operation of the above discussed embodiments. By limiting the stroke of the first piston 115 to 1/16 of an inch and allowing each succeeding power piston to move a distance precisely double that of the preceding piston, a total stroke length of 15 15/16 can be achieved in discrete intervals of 1/16 inch. The eight individual power pistons 115–118 and 153–156 or 115–119 and 153–156 (depending on the described embodiment) thus have stroke lengths of 1/16, 1/8, 1/4, 1/2, 1, 2, 4, and 8 inches, as discussed above.

For example, in the embodiment shown in FIG. 1, if the required stroke were 11 11/16 inches, valves (not shown) would be opened and high pressure air would be introduced for powering the 1/2" stroke piston 118, the 1/8" stroke piston 116 and the 1/16" stroke piston 115. The introduction of air between these pistons causes the inter-stage pusher rods 148 to advance and move the fractional stroke piston 152 a total of 11/16 of an inch. Simultaneously, valves would also open to power the 8" stroke piston 156, the 2" stroke piston 154 and the 1" stroke piston 153, thus moving the piston rod 189 the required total of 11 11/16 inches.

While the operation is similar in the embodiment shown in FIG. 11, the opening of the valves and introduction of pressurized fluid between the pistons results in the first system engaging portion 148' advancing housing 151' a distance of 1 and 11/16inches. As a result, only the 2" stroke piston 154 and 8" stroke piston 156 are moved in system 150'. Moreover, by balancing the number of pistons used in the first and second positioning systems against the combined strokes of the various systems, a maximum output stroke can be achieved by a device having a relatively small retracted length. Moreover, in the embodiment shown in FIG. 17, the movement of piston rod 189 is effected by the first positioning system 110" moving the extension tube 148" a distance of 3 and 11/16 inches. Air introduced between plate 112 and stroke piston 115, between stroke pistons 115 and 116, between stroke pistons 117 and 118, between stroke pistons 118 and 119, and between stroke pistons 119 and 154 cause engaging portion 148' to move the predetermined distance. Air introduced between stroke pistons 155 and 156 cause piston rod 189 to move the remaining 8 inches to achieve the total 11 and 11/16 inches. Moving all the valves to an exhaust position would cause the piston rod 189 to retract to its original position. Exhausting through only the 1/16" stroke valve and the 2" stroke valve would cause the piston rod to retract to the 9 and 5/8 inches stroke position, etc. Opening or exhausting any other combination of valves would move the piston rod 189 to whatever other position was desired among the 256 discrete positions it would be capable of assuming. The movements would be quick and positive and there would be no doubt about the extended position of the piston rod in the properly sized and powered system.

Although the present invention includes a 256 position mechanism, the addition of another fractional piston having a 1/32" stroke could easily double the obtainable positions to 512. Similarly, further adding a 1/64" stroke piston could increase the useful strokes to 1024.

In practice, a user of the invention would either manually or automatically, possibly using a programmable logic controller, select the stroke length desired in inches and fractions of an inch. One such programmable logic controller is a MITSUBISHI F1-ZONER. However, other well known controllers such as those produced by G.E. or ALLEN BRADLEY may also be used.

Any suitable 3-way valve can be used with the embodiments of the present invention. Well known valves which may be used are produced by ASCO, MAC valves, Parker Hannifin or Humphrey.

The kinetic seals used in the embodiments of this application are formed elastomeric rings which fit into grooves machined into pistons for the purposes of preventing air or liquid flow past the piston as it moves back and forth within a cylinder. The shapes of these rings are designed to exploit the differential fluid pressures existing on either side of the rings so that the surfaces of the seals are pressed against the groove walls and the moving surfaces of the cylinder in such a manner that no fluid can escape past the seal. Additionally, these seals provide little friction force against the movement of their piston. These seals take on many shapes and forms and are produced and sold by companies such as Parker Hannifin and Minnesota Rubber.

Numerous characteristics, advantages and embodiments of the invention have been described in detail in the foregoing description with reference to the accompanying drawings. However, the disclosure is illustrative only and the invention is not limited to the illustrated embodiments. Various changes and modifications may be effected therein by one skilled in the art without departing from the scope or spirit of the invention. For example, although the movement of the stroke pistons is described with respect to 1/16 inch increments, the stroke of each piston can be any increment including 1/10 of an inch. Also, the total stroke length is not limited to 15 and 15/16 inches. The cylinder according to the present invention could have a total stroke length that is greater or less than 15 and 15/16 inches. The embodiments including a shorter stroke length will be more compact and easier to manufacture than the 15 and 15/16 inch version. As is common, the symbol " has been used in this application as an abbreviation for the term "inch".

I claim:

1. A multi-stroke fluid cylinder comprising:

a) a first positioning system comprising a cylindrical housing having a plurality of fluid openings and containing a plurality of moveable pistons for moving a positioning member a preselected distance, each said moveable piston comprising at least one slot extending in the direction of movement of the pistons and a channel along its face for delivering fluid from said fluid openings in said cylindrical housing to between adjacent pistons, and a plurality of fluid channels for delivering a fluid between respective adjacent pistons of said first positioning system; and b) a second positioning system including:

i) at least one moveable piston for moving the positioning member a preselected distance, said at least one moveable piston of said second positioning system being independently moveable relative to said pistons of said first positioning system; and ii) at least one fluid supply member for introducing a fluid at a first pressure against said at least one piston of said second positioning system, said at least one fluid supply member of said second positioning system extending through at least one piston of said first positioning system.

2. The multi-stroke cylinder according to claim 1 wherein, each said opening of said cylindrical housing is in fluid communication with the slot of a respective one of said first positioning system pistons.

3. The multi-stroke cylinder according to claim 2 wherein said cylindrical housing includes an inner wall and an outer wall; and each of said first positioning system pistons includes a seal for engaging the inner wall of said cylindrical housing for preventing the passage of fluid therebetween.

4. The multi-stroke cylinder according to claim 2 wherein said second positioning system includes a cylinder containing said at least one second positioning system piston, at least a portion of said second positioning system cylinder being positioned within said cylindrical housing of said first positioning system.

5. The multi-stroke cylinder according to claim 4 wherein each said piston of said second positioning system includes a seal for engaging an inner surface of said cylinder.

6. The multi-stroke cylinder according to claim 1 further comprising at least one stroke limiting member including a fluid inlet through which fluid can be introduced into said at least one fluid supply member.

7. The multi-stroke cylinder according claim 6 wherein at least one fluid supply member comprises an elongated tube.

8. The multi-stroke cylinder according to claim 6 wherein said second positioning system comprises a plurality of moveable pistons and said at least one fluid supply member comprises a plurality of fluid supply members comprised of a plurality of concentrically positioned tubular members that each extend between a respective one of said stroke limiting members and a respective one of said second positioning system pistons so that each tubular member forms a fluid channel between the fluid inlet of a respective one of said stroke limiting members and a respective one of said second positioning system pistons.

9. The multi-stroke cylinder according to claim 8 wherein said second positioning system pistons each include at least two parts secured to one another with a terminal end of a respective one of said tubular members being secured between said at least two parts.

10. The multi-stroke cylinder according to claim 9 wherein each said terminal end is flared to fit between said at least two parts of a respective one of said second positioning system pistons.

11. The multi-stroke cylinder according to claim 10 wherein said stroke limiting members each have at least two parts; and each said tubular member includes a second terminal end secured between said at least two parts of a respective one of said stroke limiting members.

12. The multi-stroke cylinder according to claim 1 wherein; said positioning member has a piston rod attached to said at least one piston of said second positioning system adjacent a head assembly.

13. The multi-stroke cylinder according to claim 12 wherein said piston rod extends through said head assembly.

14. The multi-stroke cylinder according to claim 13 wherein one or more stroke limiting shafts are secured to the piston of said second positioning system adjacent said piston to which said piston rod is attached; and said limiting shafts extend through said piston to which the piston rod is attached.

15. The multi-stroke cylinder according to claim 1 wherein said first positioning system includes a plurality of rods contacting said second positioning system for imparting movement thereto.

16. The multi-stroke cylinder according to claim 1 wherein said pistons of said first positioning system are each tethered to at least one immediately adjacent piston.

17. The multi-stroke fluid cylinder of claim 1 further comprising a plurality of tethering members securing together respective adjacent pistons of the first positioning system so that the movement between adjacent pistons of said first positioning system is limited.

18. A multi-stroke fluid cylinder comprising:

a) a cylindrical housing having an inner wall including a plurality of spaced openings for delivering fluid at predetermined locations within said housing;

b) a fluid introduction plate positioned at a first end of said housing, said fluid introduction plate comprising a plurality of fluid introduction openings through which fluid can enter said multi-stroke cylinder, each said fluid introduction opening of said plate being in fluid communication with a respective one of said openings in said inner wall of said housing; and c) a positioning system comprising:

i) a plurality of movable pistons located within said housing for moving a piston rod a preselected distance, said pistons each having a length that extends substantially parallel to the length of the cylindrical housing; and ii) a fluid supply and tethering member including a hollow cylindrical portion extending within said housing and through a center of a plurality of said moveable pistons within said housing for delivering the fluid between two of said pistons.

19. The multi-stroke fluid cylinder of claim 18 further comprising a plurality of tethering members securing together respective adjacent ones of said pistons so that the movement between the respective adjacent ones of said pistons is limited.

20. The multi-stroke fluid cylinder of claim 18 wherein said fluid supply and tethering member includes openings for delivering fluid between two of said pistons proximate a second end of said housing.

21. The multi-stroke fluid cylinder of claim 18 further comprising a plurality of fluid supply members for introducing a fluid between adjacent pistons, said fluid supply members having different fluid delivery lengths.

22. The multi-stroke fluid cylinder of claim 21 wherein the fluid supply members each extend from said plate along the housing to a respective one of the openings in the inner wall of said housing.

23. A multi-stroke fluid cylinder comprising:

a) a housing comprising an inner elongated wall including a plurality of spaced openings for delivering fluid at predetermined locations within said housing;

b) a fluid introduction plate positioned at a first end of said housing, said fluid introduction plate comprising a plurality of fluid introduction openings through which fluid can enter said multi-stroke cylinder, each said fluid introduction opening of said plate being in fluid communication with a respective one of said openings in said inner wall of said housing; and c) a positioning system comprising a plurality of moveable pistons located within said housing for moving an elongated member at a second end of said housing a preselected distance, and a plurality of tethering members securing together respective adjacent ones of said moveable pistons to limit movement between the respective adjacent ones of said pistons.

24. The multi-stroke fluid cylinder of claim 23 further comprising a plurality of fluid supply members each extending from said plate along the housing to a respective one of the openings in the inner wall of said housing.

25. The multi-stroke fluid cylinder of claim 24 wherein said fluid supply members each have different fluid communication lengths.

* * * * *

UNITED STATES PATENT AND TRADEMARK OFFICE

CERTIFICATE OF CORRECTION

PATENT NO. : 6,962,103 B2
DATED : November 8, 2005
INVENTOR(S) : William C. Sandlin It is certified that error appears in the above-identified patent and that said Letters Patent is hereby corrected as shown below:

Title page,
Item [75], Inventors, replace “Dallas” with -- Waco --.

Column 16,
Line 32, replace “wherein at” with -- wherein said at --.

Signed and Sealed this

Sixth Day of June, 2006

JON W. DUDAS
*Director of the United States Patent and Trademark Office*